US006572568B2

(12) United States Patent
Huang

(10) Patent No.: US 6,572,568 B2
(45) Date of Patent: Jun. 3, 2003

(54) CIRCULARLY ROTATING EXERCISER

(76) Inventor: Shun-Tsai Huang, No. 1, Lane 160, Sec. 2, Tan-Fu Road, Tan-Tze Hsiang, Taichung Hsien (TW)

( * ) Notice: Subject to any disclaimer, the term of this patent is extended or adjusted under 35 U.S.C. 154(b) by 34 days.

(21) Appl. No.: 09/939,614

(22) Filed: Aug. 28, 2001

(65) Prior Publication Data

US 2003/0045818 A1 Mar. 6, 2003

(51) Int. Cl.[7] ..... A61H 1/00

(52) U.S. Cl. ..... 601/29; 601/32; 601/35; 601/86; 601/87; 601/93; 601/98; 601/101

(58) Field of Search ..... 601/22, 27, 29–32, 601/34, 35, 86, 87, 90, 93, 97, 98, 101, 104; 482/79–80, 148

(56) References Cited

U.S. PATENT DOCUMENTS

| | | | | | |
|---|---|---|---|---|---|
| 4,949,712 | A | * | 8/1990 | Torii | 601/35 |
| 5,107,822 | A | * | 4/1992 | Ohashi | 601/23 |
| 5,328,443 | A | * | 7/1994 | Lee | 601/92 |
| 5,372,563 | A | * | 12/1994 | Chien-Nan | 601/27 |
| 5,411,469 | A | * | 5/1995 | Wang | 601/92 |
| 5,417,644 | A | * | 5/1995 | Lee | 601/98 |
| 5,468,215 | A | * | 11/1995 | Park | 601/23 |
| 6,056,706 | A | * | 5/2000 | Hung | 601/89 |
| 6,106,491 | A | * | 8/2000 | Gianutsos | 601/104 |
| 6,342,042 | B1 | * | 1/2002 | Martin | 601/93 |
| 6,371,897 | B1 | * | 4/2002 | Huang | 601/98 |

FOREIGN PATENT DOCUMENTS

| | | | | |
|---|---|---|---|---|
| GB | 2273658 | A | * 6/1994 | A61H/1/00 |

* cited by examiner

*Primary Examiner*—Danton D. DeMille
*Assistant Examiner*—Quang D. Thanh

(57) ABSTRACT

Both feet independently supported and circularly rotating exerciser including a base seat, a driving motor, a pair of driven wheels, a transmission member, a pair of linking members and a pair of foot support members. When the driving wheel of the driving motor rotates, the transmission member is driven to make the pair of driven wheels rotate and further make the pair of linking members deflect and swing up and down. At this time, the foot support members move in a circular or substantially circular path to exercise both feet. The rotation mode of the exerciser can be changed to excerise both feet in different specific patterns.

3 Claims, 6 Drawing Sheets

CIRCULARLY ROTATING EXERCISER

BACKGROUND OF THE INVENTION

The present invention is related to a both feet independently supported and circularly rotating exerciser. Both feet of a user can be independently supported and each foot can be moved and exercised in a circular or substantially circular path. The exerciser has no abruptly returning or stopping point so as to achieve a gentle and effectively exercising effect and the user will feel more comfortable when using the exerciser. The rotation mode of the exerciser can be changed to exercise both feet of the user in different specific patterns.

FIGS. 1 and 2 show a conventional swinging exerciser for both feet of a user. The swinging exerciser has a base seat 910, a horizontal reciprocating mechanism (not shown) and a foot support member 920. The heels of both feet of a user can be rested on the foot support member 920. After the swinging exerciser is activated, the foot support member 920 will reciprocally horizontally move left and right so as to exercise the user's feet and expedite circulation of blood.

The above swinging exerciser can only move horizontally, while failing to vertically move. Therefore, the exercising effect is poor.

Furthermore, in case the horizontal displacement is too long, the left or right foot will be forcedly pulled out. As a result, the user may feel uncomfortable or even get hurt. Moreover, the speed of the leftmost and rightmost returning points is abruptly changed. The muscle and ligament of the user's feet are likely to get hurt at these points.

Also, the conventional swinging exerciser only serves to swing both feet together in monotonous pattern without any other change.

SUMMARY OF THE INVENTION

It is therefore a primary object of the present invention to provide a both feet independently supported and circularly rotating exerciser. Both feet of a user can be independently supported and each foot can be moved and exercised in a circular or substantially circular path.

It is a further object of the present invention to provide the above both feet independently supported and circularly rotating exerciser in which the exerciser has no abruptly returning or stopping point so as to achieve a gentle and effectively exercising effect and the user will feel more comfortable when using the exerciser.

It is still a further object of the present invention to provide the above both feet independently supported and circularly rotating exerciser in which the rotation mode of the exerciser can be changed to exercise both feet of the user in different specific patterns.

The present invention can be best understood through the following description and accompanying drawings wherein:

DETAILED DESCRIPTION OF THE PREFERRED EMBODIMENTS

Figure 1:
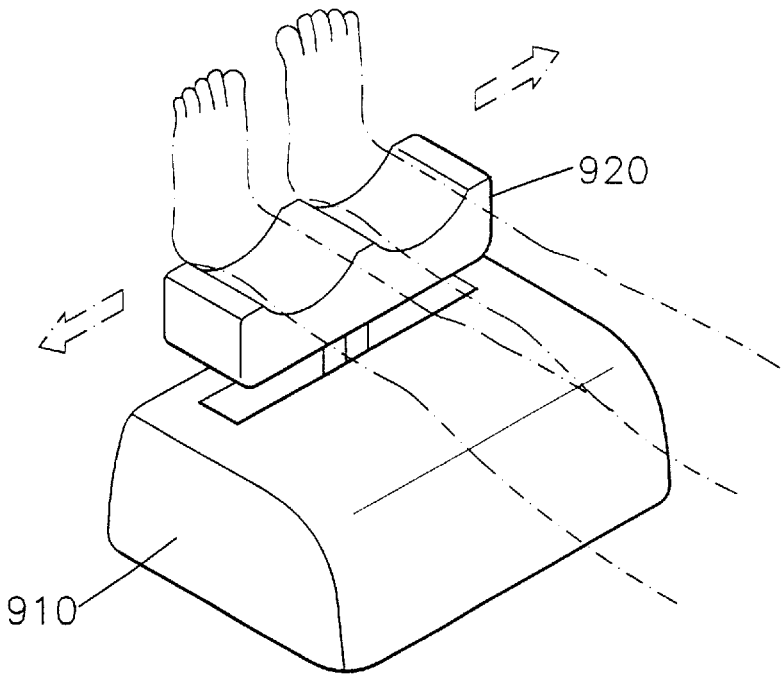
FIG. 1 (PRIOR ART)
FIG. 1 is a perspective view of a conventional both feet swinging exerciser.
Figure 2:
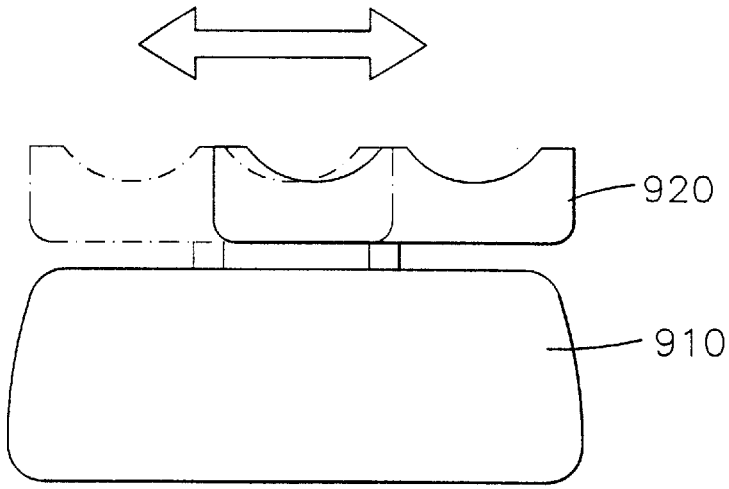
FIG. 2 (PRIOR ART)
FIG. 2 is a plane view of the conventional both feet swinging exerciser, showing the operation thereof.
Figure 3:
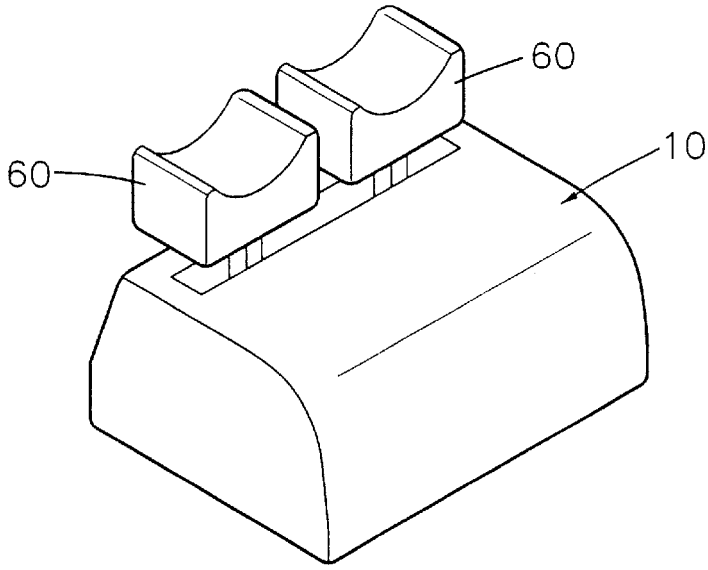
FIG. 3 is a perspective view of the present invention.
Figure 4:
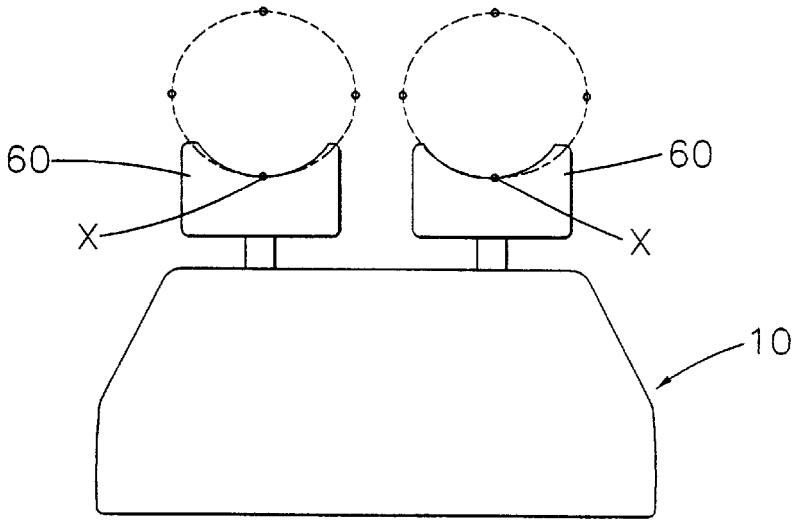
FIG. 4 is a view according to FIG. 3, showing that the foot support members of the present invention independently move in a circular or substantially circular path.
Figure 5:
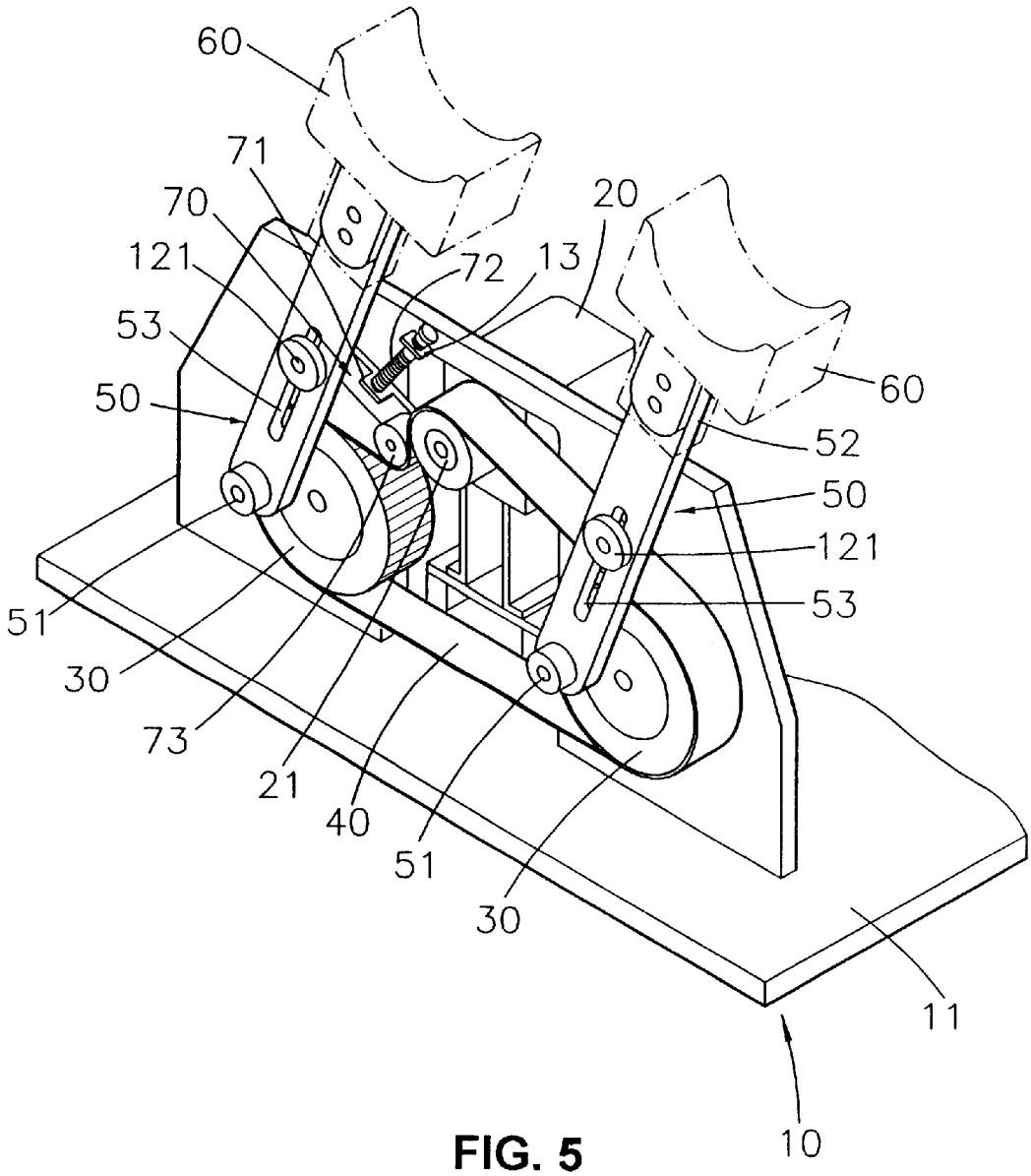
FIG. 5 shows the internal structure of the present invention.

Please refer to FIGS. 3 to 5. According to a first embodiment, the both feet independently supported and circularly rotating exerciser of the present invention includes a base seat 10, a driving motor 20, a pair of driven wheels 30, a transmission member 40, a pair of linking members 50 and a pair of foot support members 60.

The base seat 10 has a base board 11, a substantially upright support frame 12 and a casing 15. A pair of fixing pins 121 are disposed on the support frame 12. The driving motor 20 is fixed on the base board 11 of the base seat 10.

The driving motor 20 has a driving wheel 21 outward extending therefrom.

The driven wheels 30 are pivotally mounted on the support frame 12 below the fixing pins 121.

The transmission member 40 is wound on the driving wheel 21 and the driven wheels 30, whereby the driving motor 20 can drive the driven wheels 30. The transmission member 40 can be a belt, a chain or a steel cord.

Each of the linking members 50 has a first end 51, a second end 52 and a central guiding slot 53. The first end 51 is pivotally disposed a predetermined portion of the driven wheel 30 near the circumference thereof. The linking member 50 is sidably fitted on the fixing pin 121 with the fixing pin fitted in the central guiding slot 53.

The foot support members 60 are respectively fixed on the second ends 52 of the lining members 50 for supporting both feet of a user.

Accordingly, when the driving wheel of the driving motor 20 rotates, the transmission member 40 is driven to make the pair of driven wheels 30 rotate and further make the pair of linking members 50 deflect and swing up and down. At this time, the foot support members 60 move in a circular or substantially circular path as show in FIG. 4.

Figure 6A:
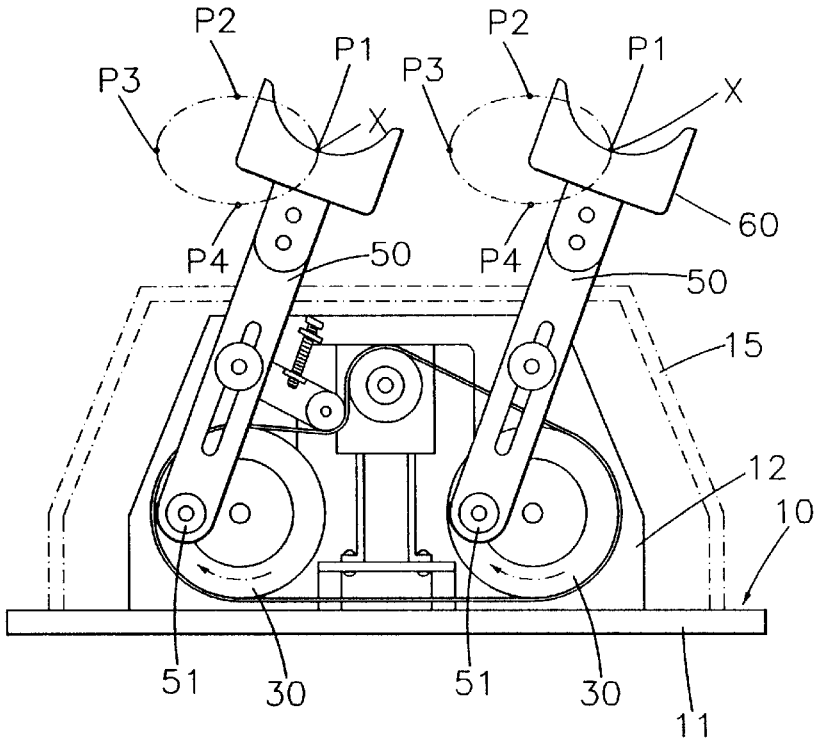
FIGS. 6A, 6B, 6C and 6D show the operation principle of the present invention.
Figure 6B:
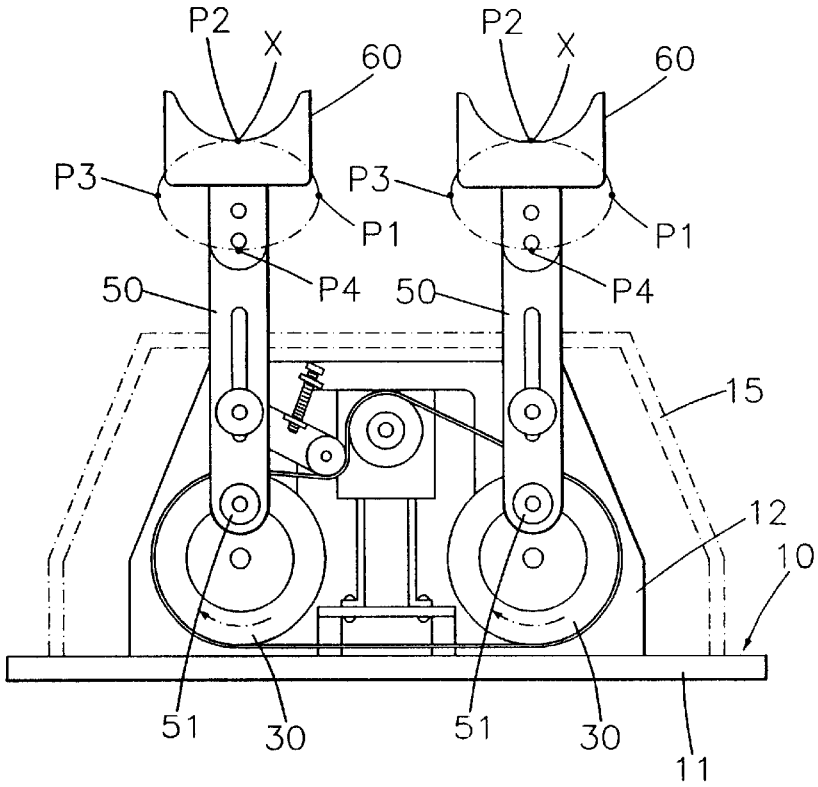
Figure 6C:
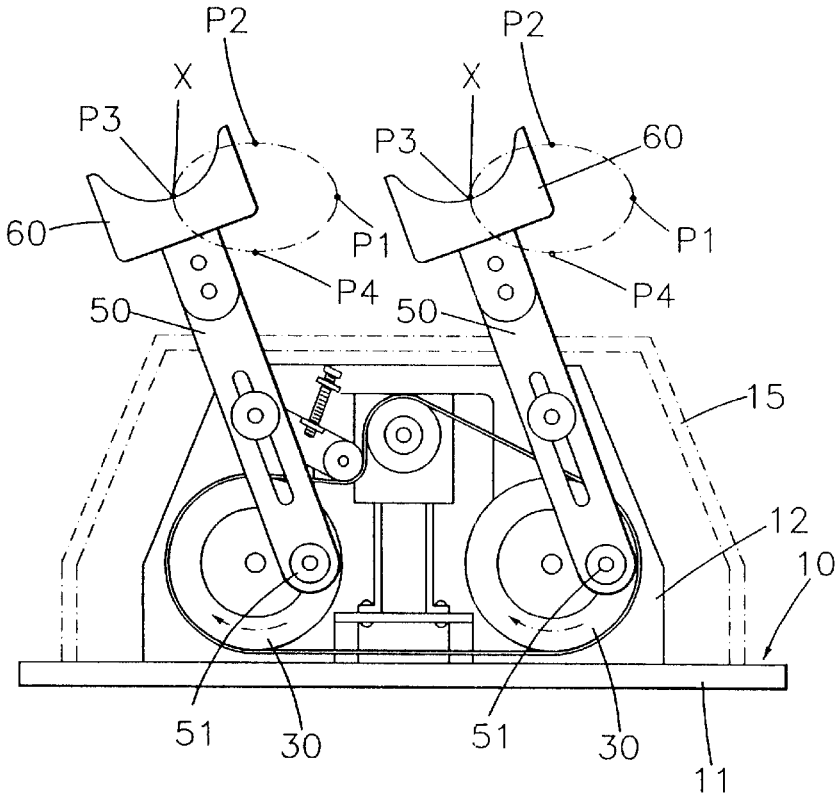
Figure 6D:
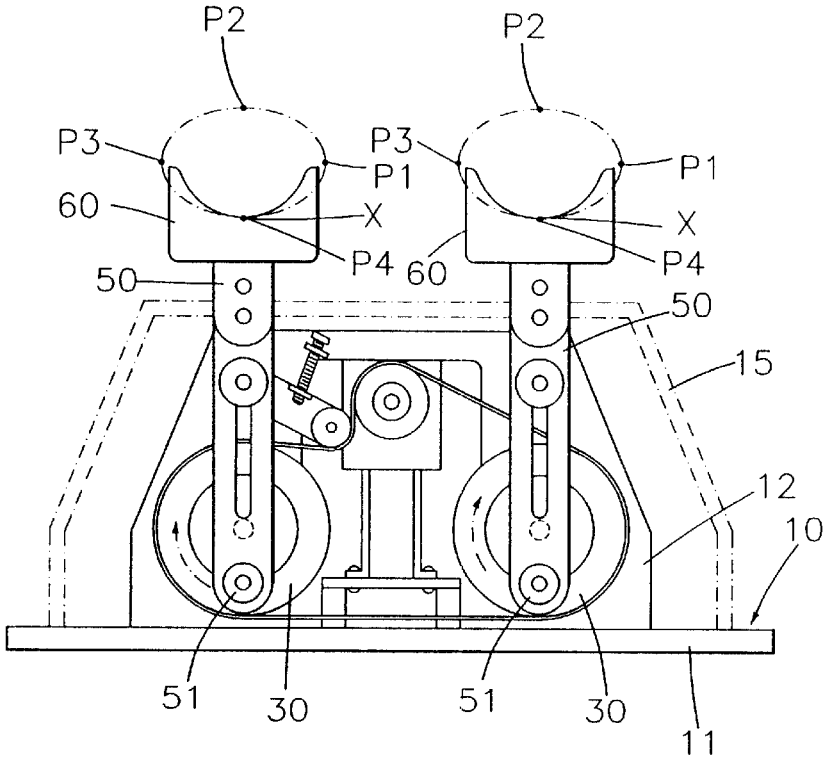

FIGS. 6A to 6D show the operation principle of the present invention. In FIG. 6A, the second end 52 of the linking member 50 is positioned at the leftmost end of the driven wheel 30. At this time, the depression point X of the foot support member 60 is positioned at moving point P1. Thereafter, the driven wheel 30 further rotates and in FIG. 6B, the second end 52 of the linking member 50 is positioned at the uppermost end of the driven wheel 30. At this time, the depression point X of the foot support member 60 is positioned at moving point P2. Similarly, the second end 52 will further move to moving point P3 as shown in FIG. 6C and then to moving point P4 as shown in FIG. 6D to complete a cycle of circular path or substantially circular path (such as an elliptic path).

It should be noted that the left and right feet of the user are respectively revolved in circular paths.

Certainly, in order to smoothen the operation of the entire transmission system, the problem of loosening and slippage of the transmission components must be overcome. As shown in FIG. 5, a first fixing end 13 is disposed on the support frame 12. A tightening press board 70 is pivotally disposed on one of the fixing pins 121. A second fixing end 71 and a tightening idler 73 are disposed on the tightening press board 70. In addition, an adjustment bolt 72 is disposed between the first fixing end 13 and the second fixing end 71. The tightening idler 73 presses the transmission member 40 and keeps the same having a certain tightness.

Figure 7:
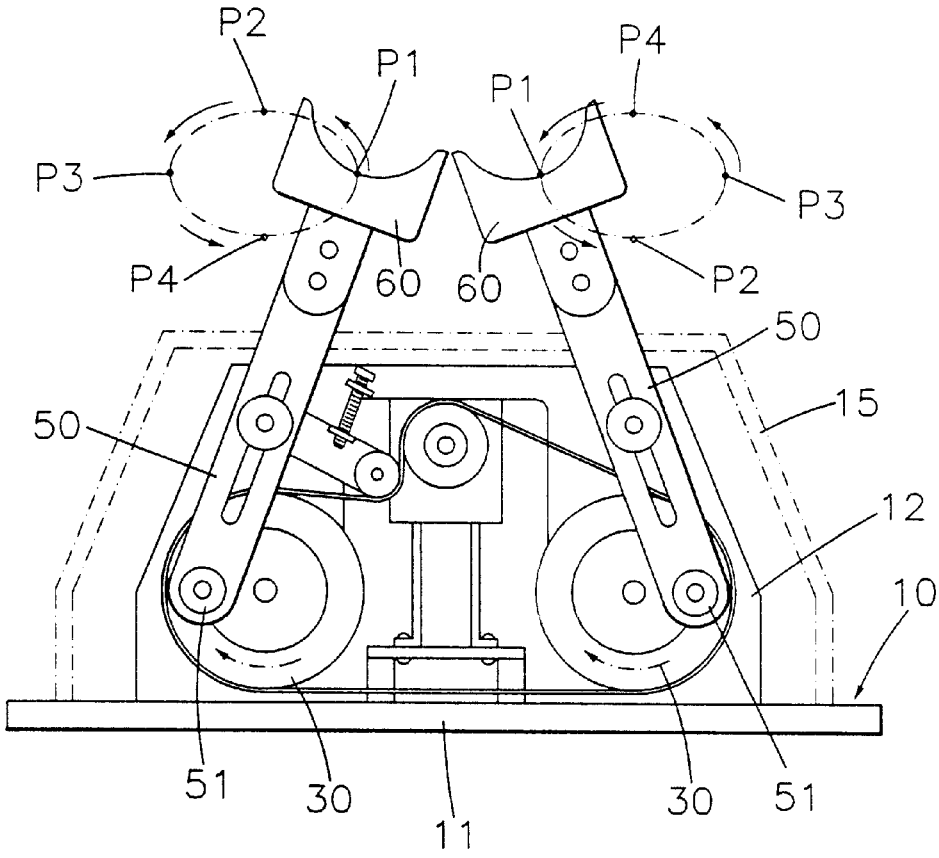
FIG. 7 is an elevational view of another embodiment of the present invention.

FIG. 7 shows another embodiment of the present invention, in which the second ends 52 of the left and right linking members 50 are respectively pivotally disposed on the leftmost and rightmost ends of the driven wheels 30 (180 degrees different). Accordingly, both feet can be revolved in such a specific pattern that the feet slightly disunite and separate, get close, separate and get close to each other. Certainly, the second ends 52 of the left and right linking members 50 can be alternatively respectively pivotally disposed on the leftmost and uppermost ends of the driven wheels 30 (90 degrees difference or lag). Accordingly, another type of specific exercising pattern can be achieved.

The present invention has the following advantages:

1. Both feet of a user can be respectively independently supported and each foot can be exercised and moved in a circular path. The exerciser of the present invention has no abruptly returning or stopping (abruptly accelerating or decelerating) point so that the exerciser is able to achieve a gentle and effectively exercising effect.
2. The heels are spaced from the hip by a constant distance without being forcedly pulled out. Therefore, the user will feel more comfortable when using the exerciser.
3. The exerciser of the present invention has variable rotation modes. The relative positions of the second ends of the linking members can be adjusted to vary the rotation mode of the exerciser. Both feet can be synchronously revolved clockwise. Alternatively, both feet can be revolved in such a specific pattern that the feet slightly disunite and separate, get close, separate and get close to each other.

The above embodiments are only used to illustrate the present invention, not intended to limit the scope thereof. Many modifications of the above embodiments can be made without departing from the spirit of the present invention.

What is claimed is:

1. Both feet independently supported and circularly rotating exerciser comprising:

a base seat having a base board, a substantially upright support frame and a casing, a pair of fixing pins being disposed on the support frame;

a driving motor fixed on the base board of the base seat, the driving motor having a driving wheel outward extending therefrom;

a pair of driven wheels pivotally mounted on the support frame below the fixing pins;

a transmission member wound on the driving wheel and the driven wheels, whereby the driving motor can drive the driven wheels;

a pair of linking members each of which has a first end, a second end and a central guiding slot, the first end being pivotally disposed a predetermined portion of the driven wheel near the circumference thereof, the linking member being slidably fitted on the fixing pin with the fixing pin fitted in the central guiding slot; and a pair of foot support members respectively fixed on the second ends of the linking members, whereby when the driving wheel of the driving motor rotates, the transmission member is driven to make the pair of driven wheels rotate and further make the pair of linking members deflect and swing up and down so as to make the foot support members move in a circular or substantially circular path.

2. Both feet independently supported and circularly rotating exerciser as claimed in claim 1, wherein a first fixing end is disposed on the support frame, a tightening press board being pivotally disposed on one of the fixing pins, a second fixing end and a tightening idler being disposed on the tightening press board, and adjustment bolt being disposed between the first fixing end and the second fixing end, the tightening idler pressing the transmission member and keeping the same having a certain tightness.

3. Both feet independently supported and circularly rotating exceriser as claimed in claim 1, wherein the transmission member is one of a belt, a chain and a steel cord.

* * * * *